US006659823B1

(12) United States Patent
Mosna et al.

(10) Patent No.: US 6,659,823 B1
(45) Date of Patent: Dec. 9, 2003

(54) SAFETY THROW ROPE DISPENSER

(75) Inventors: Kirk Mosna, Ancaster (CA); Graham Hills, Hamilton (CA); Steve Orzel, Hamilton (CA)

(73) Assignee: Fox 40 International Inc., Hamilton (CA)

( * ) Notice: Subject to any disclaimer, the term of this patent is extended or adjusted under 35 U.S.C. 154(b) by 0 days.

(21) Appl. No.: 10/314,124

(22) Filed: Dec. 9, 2002

(51) Int. Cl.[7] ..... B63C 9/26
(52) U.S. Cl. ..... 441/84
(58) Field of Search ..... 441/84, 85, 80

(56) References Cited

U.S. PATENT DOCUMENTS

| | | | |
|---|---|---|---|
| 3,676,882 | A | 7/1972 | Lindqvist |
| D246,542 | S | 11/1977 | Hull |
| RE29,728 | E | 8/1978 | Franklin |
| 4,661,077 | A | 4/1987 | Griffith et al. |
| 4,713,033 | A | 12/1987 | Cameron |
| 4,836,815 | A | 6/1989 | Spurgeon |
| 5,154,653 | A | 10/1992 | Ketterman et al. |
| 5,562,512 | A | 10/1996 | Samelian |
| 5,690,524 | A | 11/1997 | Salvemini |
| 5,895,299 | A | 4/1999 | Hyde |
| 6,019,651 | A | 2/2000 | Driscoll et al. |
| RE36,965 | E | 11/2000 | Salvemini |
| 6,186,847 | B1 | 2/2001 | Ketterman et al. |
| 6,257,942 | B1 | 7/2001 | Groover |
| 6,398,606 | B1 | 6/2002 | Borrelli |
| 6,413,134 | B1 | 7/2002 | Wahl et al. |

OTHER PUBLICATIONS

The Balcan Emergency Life Line(B.E.L.L) Website http://www.throwlines.com/bell.htm.

*Primary Examiner*—Jesus D. Sotelo
(74) *Attorney, Agent, or Firm*—Ingrid E. Schmidt

(57) ABSTRACT

A dispenser for a safety throw rope is made from a rigid hollow body that defines a cavity having a bung hole at one end and a looped hollow handle portion at another end spaced from the bung hole. A length of rope is received in the cavity and is coupled to a closure assembly for closing the bung hole. The other end of the rope is looped around the handle portion inside the cavity and coupled to the handle portion so that the body may be thrown and the rope will pay out of the bung hole in a rescue situation.

8 Claims, 6 Drawing Sheets

SAFETY THROW ROPE DISPENSER

FIELD OF THE INVENTION

This invention relates to a dispenser for a safety throw rope which would normally be used in situations where a person in distress may need assistance, for example, to be towed out of the water to the safety of a watercraft or shoreline.

BACKGROUND OF THE INVENTION

Throw bags for containing a length of rescue rope to be thrown to persons in distress are known. An example of such a bag is described in U.S. Pat. No. 3,676,882. It will be seen that the throw bag includes a weight so that the bag can be thrown more accurately towards the victim. Conveniently, the bag has a handle portion which the victim can grasp. One of the problems experienced with such throw bags is that the weight of the bag may cause it to sink in water rescue situations. The water rescue device described in U.S. Pat. No. 4,836,815 includes a buoyant housing for storing a length of line which may be payed out during an emergency. The housing includes a battery powered light which is activated by pulling on the end of the life line affixed to the housing.

Buoyant devices such as a life ring of the kind shown in D246,542 and which provide integral handles for the victim to hang on to are also known. One of the problems associated with such life saving rings is the difficulty in storing a sufficient length of a throw rope to make the ring useful. One manner of addressing the problem is to include on the life ring or flotation disc a peripheral groove for storing the life line. Such a device is shown in U.S. Pat. No. 6,019,651. A problem which arises with using such a device is that the thrower must have a significant amount of skill to accurately throw the device to the intended location while the life line is unwound during rotation of the floatation disc.

A need therefore exists to provide a safety device for use in particular in a water rescue environment which is buoyant and which can easily be thrown to the intended location with sufficient rope to be effective.

SUMMARY OF THE INVENTION

In accordance with the invention, there is provided a dispenser for a safety throw rope which has a rigid hollow body that defines a cavity for receiving a length of rope. The body has a bung hole at one end through which the length of rope may be payed out. The body also has a looped hollow handle portion at another end spaced from the bung hole. The rope is coupled to a closure assembly for the bung hole at one end and to the handle portion inside the cavity at another end. When the closure assembly is separated from the body, the body may be thrown and the rope is payed out of the bung hole.

In a preferred embodiment of the invention, the rope is looped around the handle portion inside the cavity. Most preferably, the body has a rope locator dimensioned to be received through the opening of the body and defining two spaced passages for receiving the rope therethrough. The rope is threaded through a first passage, around the handle portion inside the cavity and through a second passage in the rope locator.

BRIEF DESCRIPTION OF THE DRAWINGS

In order the invention may be more clearly understood, reference will be had to the following drawings in which.

DETAILED DESCRIPTION WITH REFERENCE TO THE DRAWINGS

Figure 7:
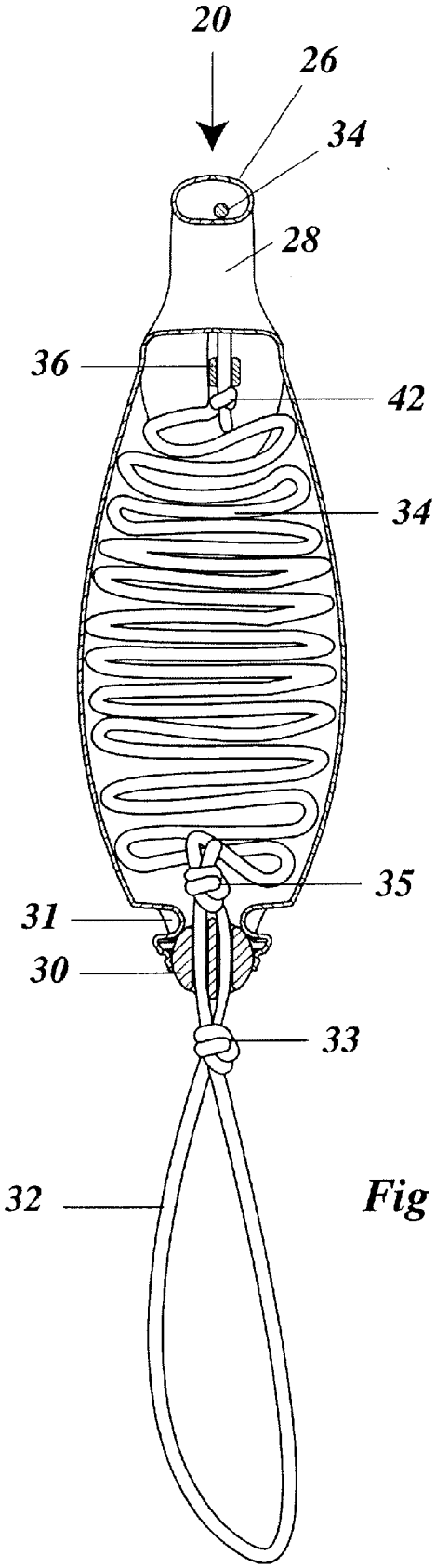
FIG. 7 is a cross-sectional view through the dispenser of FIG. 1 drawn on line 7—7.

A dispenser for a safety throw rope in accordance with the invention is generally indicated in the drawings by reference numeral 20. The dispenser has a rigid hollow body 21 which is made from a suitable synthetic plastic material and which is UV resistant and could, for example, consist of synthetic plastic material which may easily be formed into the desired shape by blow moulding. From FIG. 2, it will be seen that the dispenser body 21 defines a cavity 22 that has a bung hole 24 at one end and a hollow handle portion 26 at another end. The handle portion is an integral part of the dispenser body 21 and is formed into a loop that defines an opening 28 so that the dispenser can conveniently be grasped by a person in distress. A closure assembly 30 is provided for releasably closing the bung hole 24. The closure assembly 30 consists of a fluted bung which seats in the bung hole 24 and which is prevented from moving into the dispenser body 21 by a detent 31 (FIG. 7). The bung may be removed by tugging on a grip portion 32 shown in the drawings as a length of rope formed into a loop and coupled to the closure assembly 30.

Figure 6:
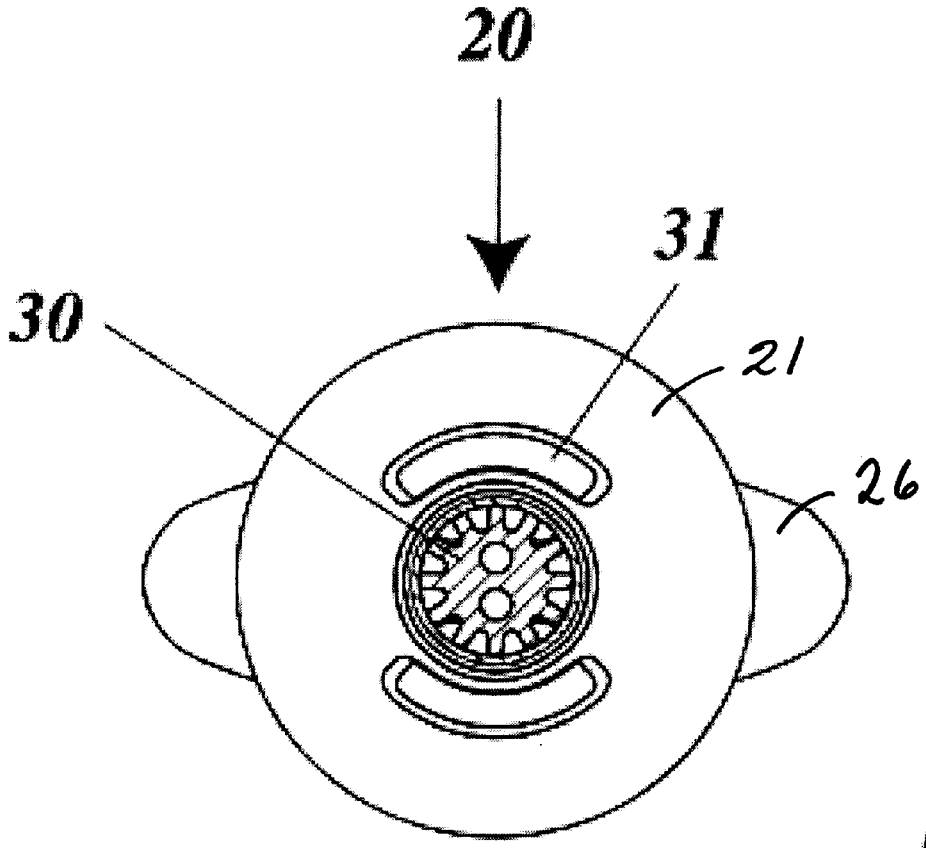
FIG. 6 is an end elevation view of the dispenser.

The shape of the fluted bung forming part of the closure assembly 30 is shown in greater detail in FIG. 6. It will be seen that the bung has a plurality of radially extending ribs dimensioned to abut in a close-fitting relationship with the bung hole 24. The ribs are adapted to flex to facilitate entry and exit from the bung hole 24. An air space is defined between the ribs to allow air to circulate into the body cavity 22 to minimize fouling of the contents of the body cavity. Conveniently, the ribs also define channels for draining water from the body cavity 22 so that the contents will be relatively dry.

Figure 1:
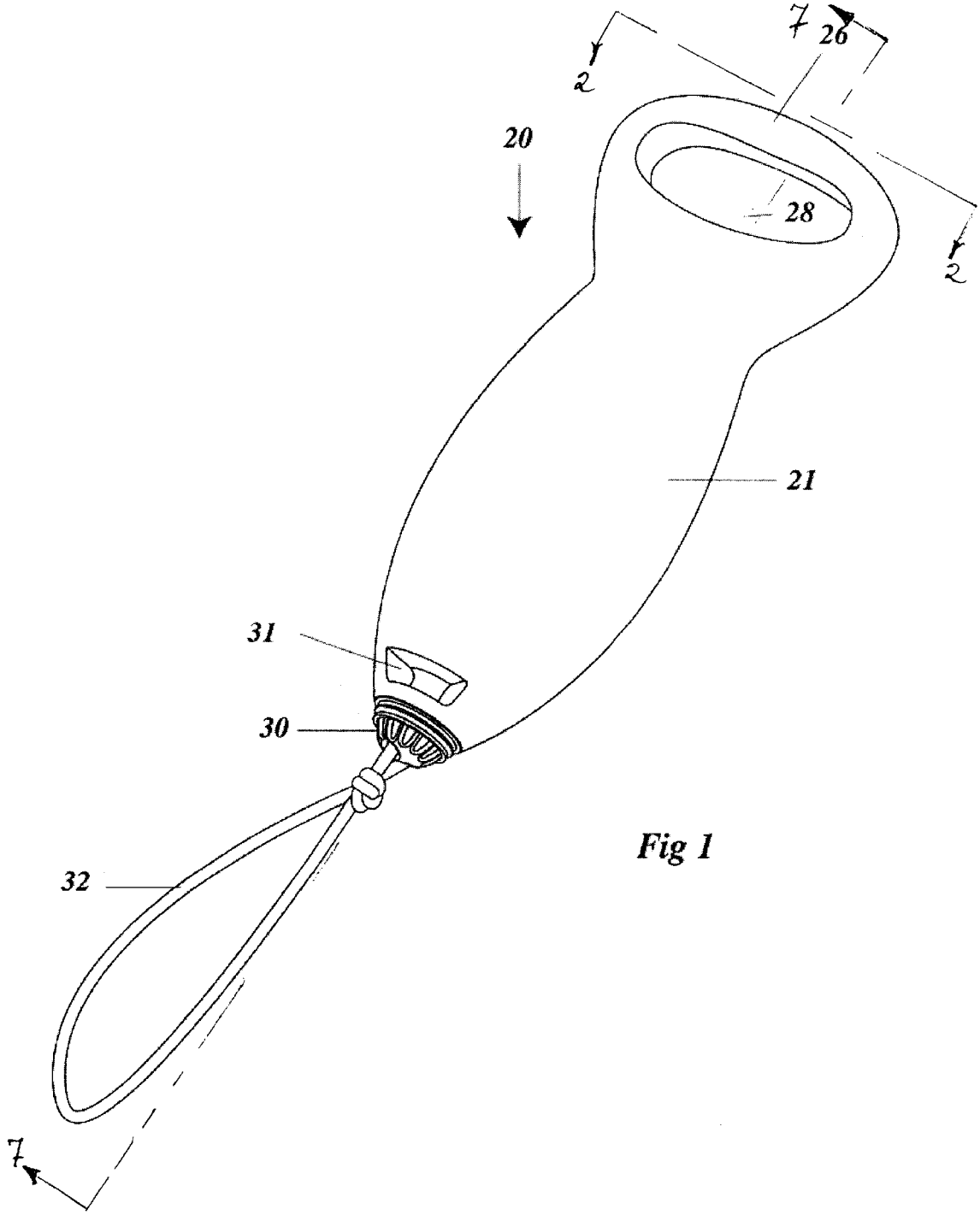
FIG. 1 is perspective view of a dispenser for a safety throw rope made in accordance with the invention.
Figure 2:
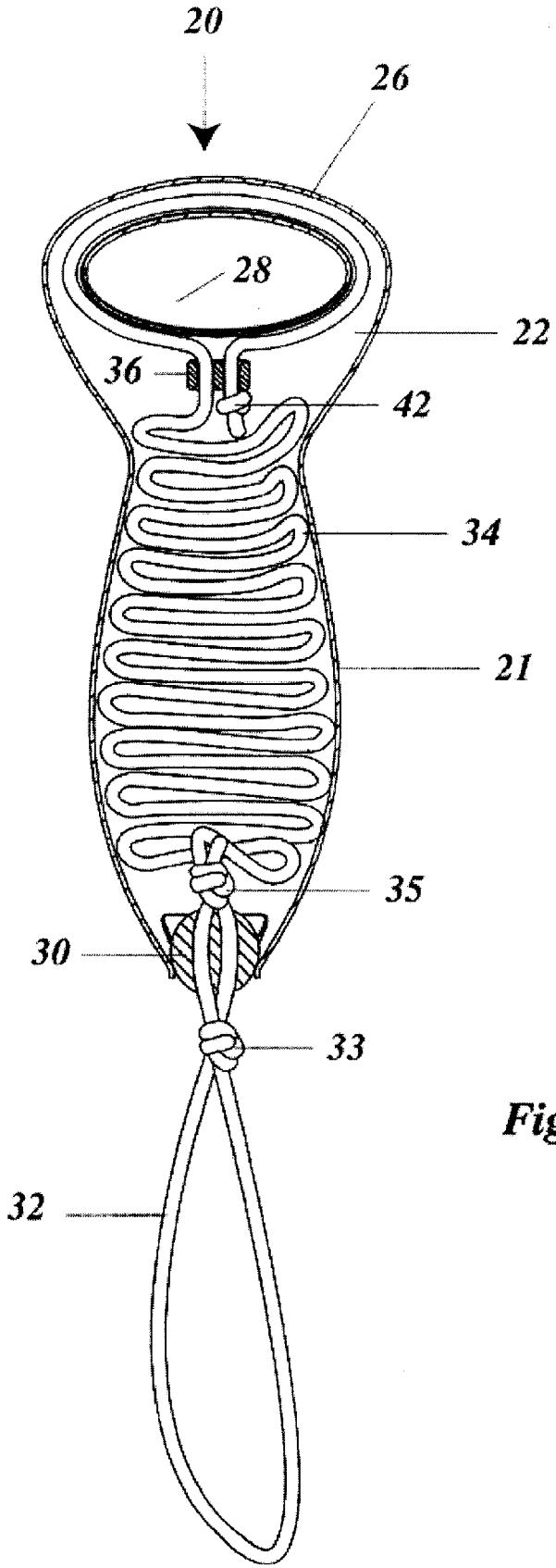
FIG. 2 is a cross-sectional view through the dispenser of FIG. 1 drawn on line 2—2 with the throw rod stored inside.

In accordance with current Coast Guard regulations, a buoyant heaving line or rope 34 not less than 15 meters in length is stored inside the cavity 22. In the embodiment shown, the rope 34 has a free end which forms the grip portion 32 and which is secured to the bung by knots 33, 35 (FIG. 2). The other end of the rope 34 is coupled to the handle portion 26. In the assembled condition shown in FIGS. 2 and 7, the rope 34 is positioned with a rope locator indicated by reference numeral 36. The rope locator 36 (shown in detail in FIG. 4) is a discrete element formed with two spaced passages 38, 40 dimensioned to receive the rope 34 therethrough.

In order to assemble the rope 34 with the rope locator 36 in the operational position shown in the drawings, a free end of the rope is first threaded through a first passage 38 (FIG. 4) in the rope locator 36 outside of the dispenser body 21. A length of the rope 34 is then pulled through the passage 38 for a sufficient length to traverse the length of the dispenser 20 through the handle portion 26 and to emerge from the bung hole 24. Conveniently, a weight may be attached to a free end of the rope 34 in order to guide it inside the cavity 22 through the handle portion 26. The free end of the rope 34 is then threaded through a second passage 40 (FIG. 4) in the rope locator 36 outside of the dispenser 20 and knotted into a stop knot 42 suitable for restraining the rope 34 from passing through the passage 40. The rope locator 36 is then introduced into the cavity 22 through the bung hole 24 and snugged up against the handle portion 26 by tugging on the end of the rope secured to the closure assembly 30.

Figure 5:
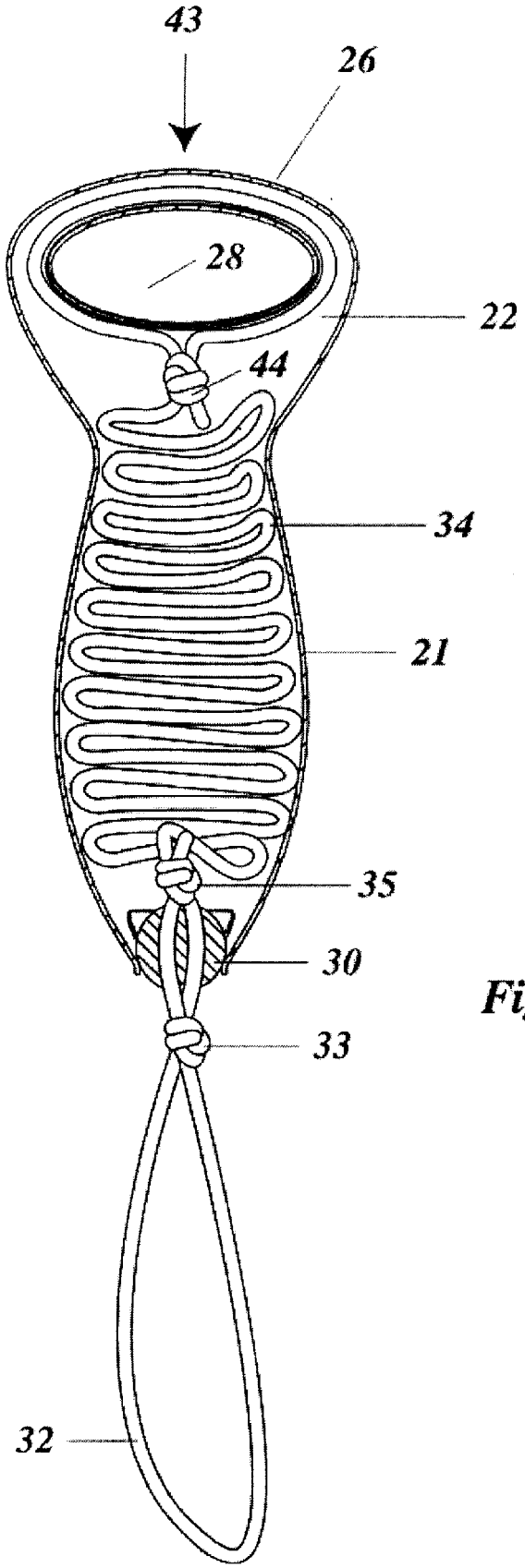
FIG. 5 is a similar view to FIG. 2 showing an alternative embodiment of the invention without a rope locator device.

In an alternative embodiment 43 of the invention shown in FIG. 5, the rope 34 is looped around the handle portion 26 inside the cavity 22 and has a free end secured to itself with a slip knot 44. The remaining portions are identical and are identified by like numerals.

Figures 3, 4:
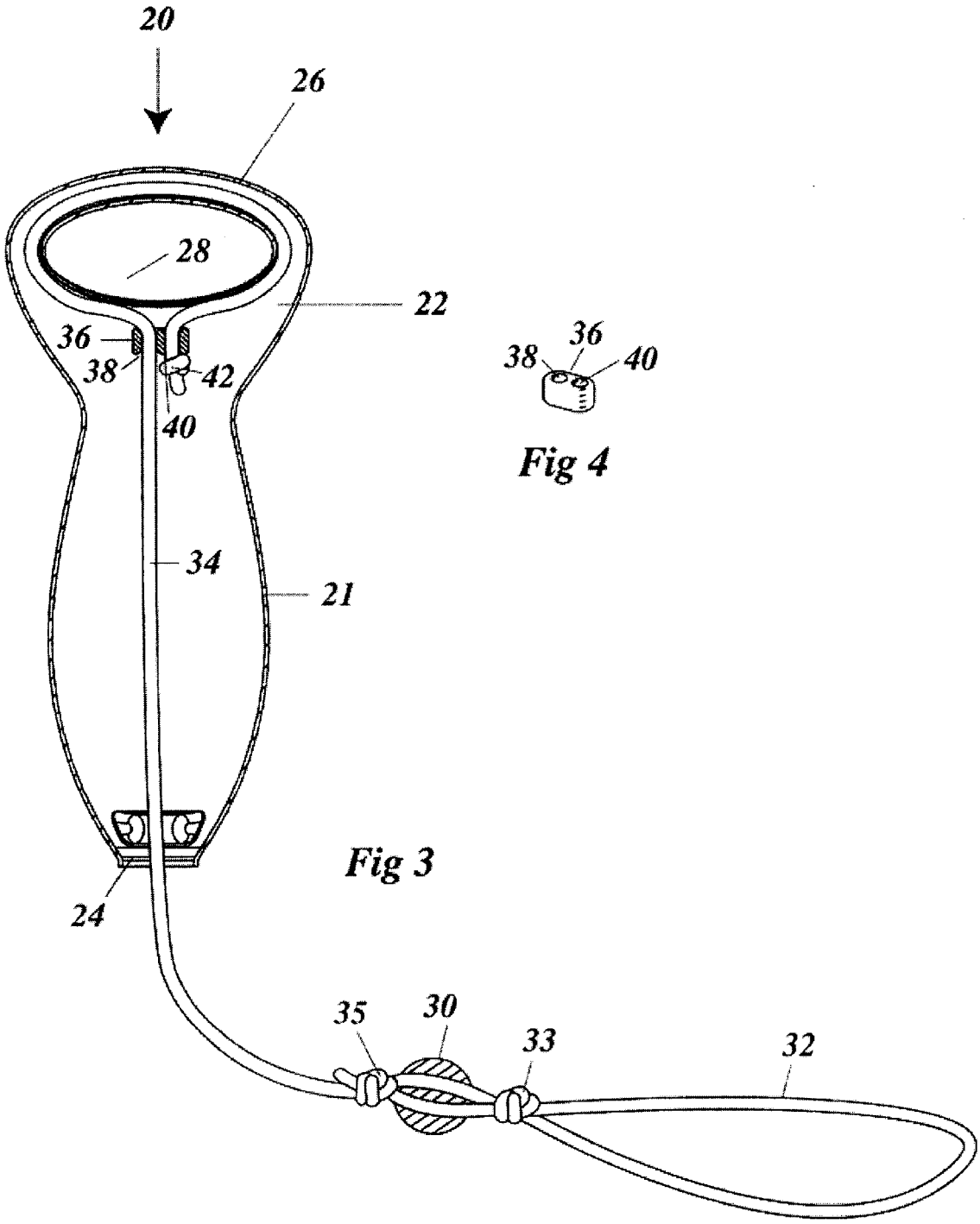
FIG. 3 a cross-sectional view through the dispenser of FIG. 1 with the throw rope payed out.
FIG. 4 is a perspective view of a rope locator forming part of the dispenser of FIG. 1.

In use, it will be appreciated that the dispenser body 20 will be separated from the closure assembly 30 as shown in FIG. 3 and that the closure assembly will be grasped with one hand by the grip portion 32 while the other hand will grab the body 21 of the dispenser to throw it to the required location. Conveniently, the body 21 of the dispenser is waisted so that it can easily be held in one hand. The weight of the dispenser 20 is sufficient to facilitate accurate throwing of the dispenser and the rope 34 pays out easily from the bung hole 24 along the trajectory of the thrown dispenser. The handle 26 may conveniently be grasped by the person in distress being rescued and because the dispenser body 21 is buoyant, it may easily be found even if the throw is not accurate or the intended recipient is not alert enough to immediately grasp the device. With a firm grip on the handle portion 26 by the person being rescued, the thrower of the device can begin to tow the victim into a safe location such as a shoreline of a moving river or a rescue craft.

After use, the rope 34 is easily restored to a useable condition by stuffing the rope into the cavity 22. The closure assembly 30 keeps the rope intact until it is pulled and prevents inadvertent release of rope so that the device is always ready to be used while minimizing the likelihood of the rope becoming tangled or snagged.

It will of course be understood that several variations may be made to the above described embodiment of the invention within the scope of the appended claims. In particular, it will be understood that the shape of the dispenser 20 may be varied, as required, to suit the intended application and to satisfy aesthetic concerns. Other variations, as will be apparent to those skilled in the art may be made for coupling the rope to the handle portion and to the closure assembly.

What is claimed is:

1. A dispenser for a safety throw rope, the dispenser having a rigid hollow body defining a cavity having a bung hole at one end and a looped hollow handle portion at another end spaced from said bung hole for receiving a length of rope therethrough;

a closure assembly adapted to releasably close said bung hole; and a length of rope coupled to said closure assembly at one end and coupled to said handle portion at another end, so that upon separation of the closure assembly from the body, the body may be thrown and the rope will pay out of the bung hole.

2. A dispenser for a safety throw rope according to claim 1 in which the closure assembly has a grip portion for grasping the closure assembly during pay out.

3. A dispenser for a safety throw rope according to claim 1 in which the rope is looped around the handle portion inside said cavity and has a free end secured to itself.

4. A dispenser for a safety throw rope according to claim 1 in which the body has a rope locator dimensioned to be received through said bung hole, the rope locator defining two spaced passages for receiving rope therethrough, the rope being adapted to be threaded through a first said passage, around the handle portion inside said cavity and through a second said passage.

5. A dispenser according to claim 1 in which the closure assembly has a fluted bung adapted to seat in said bung hole, the bung having a plurality of radially extending ribs dimensioned to abut in a close-fitting relationship with said bung hole and defining air spaces therebetween to allow air to circulate into the cavity and defining channels for draining water from the cavity.

6. A dispenser for a safety throw rope, the dispenser having a rigid hollow body defining a cavity having a bung hole at one end and a looped hollow handle portion at another end spaced from said bung hole for receiving a length of rope therethrough;

a closure assembly adapted to releasably close said bung hole having a grip portion for grasping the closure assembly during pay out;

a rope locator dimensioned to be received through said bung hole, the rope locator defining two spaced passages for receiving rope therethrough; and a length of rope coupled to said closure assembly at one end, the rope being threaded through a first said passage in said rope locator, around the handle portion inside said cavity, through a second said passage in said rope locator and secured with a stop knot for restraining the rope from passing through said second passage, so that upon separation of the closure assembly from the body, the body may be thrown and the rope will pay out of the bung hole.

7. A dispenser according to claim 6 in which the closure assembly has a grip portion for grasping the closure assembly during pay out, the grip portion consisting of a length of rope formed into a loop.

8. A dispenser according to claim 6 in which the closure assembly has a fluted bung adapted to seat in said bung hole, the bung having a plurality of radially extending ribs dimensioned to abut in a close-fitting relationship with said bung hole and defining air spaces therebetween to allow air to circulate into the cavity and defining channels for draining water from the cavity.

* * * * *